US006030146A

United States Patent [19]

Nicolen et al.

[11] Patent Number: 6,030,146

[45] Date of Patent: Feb. 29, 2000

[54] SCUBA TANK BOUYANCY COMPENSATOR

[76] Inventors: Wayne L. Nicolen, 5120 Deep Point Dr., Kalamazoo, Mich. 49002; Jerry M. Kulas; Dale E. Walriven, both of 2244 E. Cork St., #3B, Kalamazoo, Mich. 49001

[21] Appl. No.: 09/026,453

[22] Filed: Feb. 19, 1998

[51] Int. Cl.[7] ..... B63C 11/22

[52] U.S. Cl. ..... 405/186; 114/315; 441/88; 441/106

[58] Field of Search ..... 405/186, 185; 114/315; 441/86, 88, 108, 121; 248/311.2, 910

[56] References Cited

U.S. PATENT DOCUMENTS

| | | | |
|---|---|---|---|
| 3,269,129 | 8/1966 | Zambrano | 405/186 |
| 3,495,413 | 2/1970 | Pinto | 405/186 |
| 3,648,324 | 3/1972 | Stradella et al. | 405/186 X |
| 3,964,266 | 6/1976 | Bartlett | 405/186 |
| 4,455,718 | 6/1984 | Finnern | 405/186 |
| 5,074,714 | 12/1991 | Franco | 405/186 |
| 5,199,820 | 4/1993 | Nicklo | 405/186 |
| 5,311,833 | 5/1994 | Van Tassel et al. | 405/186 X |
| 5,363,790 | 11/1994 | Matsuoka | 114/315 |
| 5,788,475 | 8/1998 | Henderson | 405/186 |

FOREIGN PATENT DOCUMENTS

| | | |
|---|---|---|
| 964 217 | 7/1964 | United Kingdom . |
| 2 228 901 | 9/1990 | United Kingdom . |

*Primary Examiner*—Dennis L. Taylor

[57] ABSTRACT

A tank buoyancy compensator for an underwater breathing tank comprises a ballast boot having a tubular portion to receive the end of the tank remote from the diver's head. The ballast boot includes an end portion that includes weight retention pin for releasably retaining one or more annular ballast weights on the end portion. A connector is attached to the retention pin and is operable by the diver at convenient location on the ballast boot for releasing the retention pin to jettison the weight(s) from the boot, for example, when the diver experiences an emergency situation.

19 Claims, 5 Drawing Sheets

SCUBA TANK BOUYANCY COMPENSATOR

FIELD OF THE INVENTION

The present invention relates to an underwater diving tank for supplying air or other breathable gas to a diver and, more particularly, to a buoyancy compensator device for an underwater diving tank.

BACKGROUND OF THE INVENTION

Scuba divers typically use a conventional aluminum or steel compressed air breathing tank (scuba tank) strapped on the diver's body with the tank located on the diver's back. Such scuba diving tanks are well known and available commercially.

Scuba divers generally prefer to swim under water at an optimum swimming attitude where the diver's body is generally horizontal. The air tank strapped to the diver's back initially will be in a position generally parallel relative to the diver's desired horizontal body orientation as schematically shown, for example, in FIG. 1A. However, as the scuba diver swims underwater over a period of time, air in the tank is consumed and results in the tank becoming more buoyant and assuming a less than optimum attitude relative to the diver's body as schematically shown, for example, in FIG. 1B. In particular, the end of the air tank remote from the diver's head typically will rise relative to the diver's body as a result of consumption of air. The increased buoyancy of the air tank tends to buoy the diver's body toward an inclined angle as also schematically shown in FIG. 1B. The diver then must exert extra effort in order to try to maintain the optimum horizontal swimming attitude under water.

Diving equipment manufacturers have attempted to address this problem of increased tank buoyancy over diving time and resultant loss of optimum diver's swimming attitude by adding ballast weight to the tank. However, ballast weight has been added to the tank outer diameter at locations where the diver cannot readily eject the ballast in an emergency situation when the diver needs to surface rapidly and/or where the ballast positioned at a location relative to the tank that is less than effective at overcoming the problem of tank buoyancy, requiring increased ballast weight in order to address the tank buoyancy problem.

It is an object of the present invention to provide an underwater breathing tank with a buoyancy compensator that overcomes the aforementioned problem of tank buoyancy in a manner that permits the diver to readily jettison or eject ballast weight in a situation when the diver needs to surface rapidly.

It is another object of the present invention to provide an underwater breathing tank with a buoyancy compensator that overcomes the aforementioned problem of tank buoyancy by providing ballast weight at a location on the tank that improves the effect of the ballast weight.

SUMMARY OF THE INVENTION

The present invention provides a tank buoyancy compensator for an underwater breathing tank wherein the buoyancy compensator comprises in one embodiment of the invention a ballast boot having a tubular portion to receive the end of the tank remote from the diver's head and tank regulator. The ballast boot includes an end portion that includes weight retention means for releasably retaining one or more ballast weights on the end portion and means operable by the diver for releasing the weight retention means to jettison the weight(s) from the boot, for example, when the diver experiences an emergency situation.

In a particular embodiment of the present invention, the end portion of the ballast boot includes an annular recess defined about an axially extending post of the end portion. The annular recess is adapted to receive an annular weight which is releasably retained in the recess about the post by a releasable retention pin that extends through and/or around the post to retain the weight in the recess. The retention pin is connected to a release connector disposed in a position on the ballast boot as to be readily accessible for actuation by the diver to release the retention pin and thereby release the weight for jettisoning from the ballast boot.

The present invention is advantageous in that the buoyancy compensator can be readily secured to a underwater breathing tank by slip frictional fitting it on the end of the tank remote from the diver's head without the need for straps or other special fastening devices. The buoyancy compensator is secured on the tank in a manner that does not protrude substantially beyond the sidewall of the tank, thereby not hindering the diver's maneuverability and minimizing drag during underwater diving unlike the compensator devices described in U.S. Pat. Nos. 3,495,413; 3,964,266; 5,074,714; 5,199,820; and 5,363,790. In addition, the buoyancy compensator overcomes the aforementioned problem of increased tank buoyancy over time in a manner that permits the diver to readily jettison or eject ballast weight in a situation when the diver needs to surface rapidly. Moreover, the ballast weight is located on the buoyancy compensator at a location that optimizes the effect of the ballast weight so as to require less ballast.

The above and other objects and advantages of the present invention will become more readily apparent from the following detailed decription taken with the following drawings.

DESCRIPTION OF THE DRAWINGS

FIG. 1A is a schematic drawing illustrating a scuba diver's optimum body attitude for swimming underwater, while

FIG. 5A is a schematic drawing illustrating a scuba diver's optimum body attitude for swimming underwater with the ballast boot of the invention secured on the tank end remote from the diver's head, while

DETAILED DESCRIPTION OF THE INVENTION

Figure 1A:
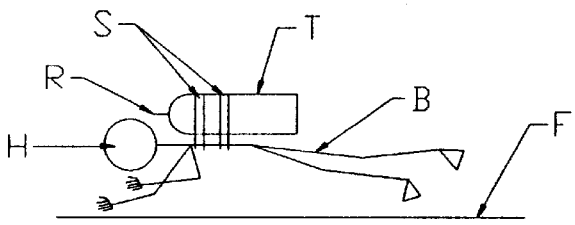
Figure 1B:
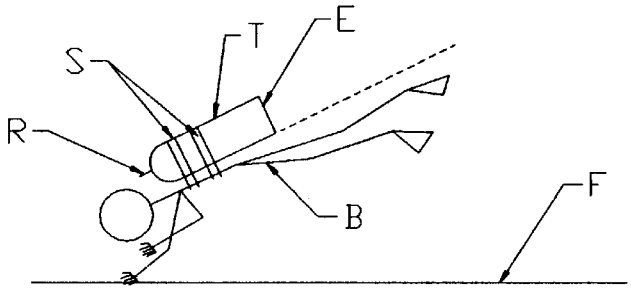
FIG. 1B is a schematic drawing illustrating an inclined attitude of the scuba tank and diver's body following a period of underwater swimming as a result of increased tank buoyancy.

Referring to FIG. 1A, a scuba diver's optimum body attitude for swimming underwater is schematically illustrated. As is apparent, the optimum attitude of the diver's body B for underwater swimming is generally horizontal relative to the sea, river, or lake floor F with the generally cylindrical scuba tank T also horizontal. FIG. 1B is a schematic drawing illustrating the adverse change in the diver's attitude underwater following a period of underwater swimming that results in loss or usage of enough air from the tank to cause the tank T to become more buoyant over time and to assume an inclined position relative to horizontal and that tends to cause the diver's body B also to assume an inclined position underwater. The inclined position of the tank T and diver's body B adversely affects the diver's ability to swim underwater, requiring additional swimming effort and usage of tank air on the diver's part to try to maintain a horizontal body attitude.

The present invention provides a tank buoyancy compensator 10 for overcoming the problem of such tank buoyancy and its aforementioned adverse effects on diver attitude. In one embodiment of the invention, the buoyancy compensator comprises a molded plastic (e.g. polypropylene) ballast boot 11 having an elongated, tubular, generally cylindrical sleeve portion 12 having an inner diameter to receive the generally cylindrical end E of the tank T remote from the diver's head H and tank regulator R in a slip and frictional fit to thereby secure the end E of the tank T in the ballast boot 11. Typically, the diver inserts or positions the end E of the tank T in the direction of the arrows in FIG. 2 into the tubular sleeve portion 12 to this end. The tubular sleeve portion has a slight inward taper from the bottom toward the top thereof so as to provide frictional engagement with the tank sidewall as shown in FIG. 3. An exemplary inner diameter of the tubular sleeve portion 12 proximate the bottom 12*a* of the sleeve portion is about 7.25 inches and an exemplary inner diameter of the tubular sleeve portion 12 proximate the top 12*b* of the sleeve portion is about 7.20 inches, both for an outer tank diameter of 7.25 inches.

As shown in FIG. 3, the outer diameter of the tubular sleeve portion 12 of the ballast boot 11 preferably is selected so as not to protrude substantially beyond the outer diameter of the tank end E. For example, an exemplary outer diameter of the tubular sleeve portion 12 is about 7.625 inches for the outer tank diameter of 7.25 inches. Lack of protrusion of the tubular boot sleeve portion 12 substantially beyond the tank outer diameter is advantageous so as not to hinder the diver's maneuverability and to minimize drag of the tank/buoyancy compensator on the diver during underwater swimming. A peripheral lip 12*c* may optionally be provided on the tubular sleeve portion 12 for the purpose of providing additional hoop strength of the sleeve portion 12. The lip 12*c* can have a width of 0.25 inch to this end.

The ballast boot 11 includes an end portion 14 that at least partially closes off the bottom 12*a* of the tubular sleeve portion 12. The end portion 14 extends in a direction transverse to the longitudinal axis A of the tank and tubular sleeve portion 12 to this end. The end portion 14 typically is molded plastic integrally molded with the tubular sleeve portion 12, although it may be formed separately and attached thereto by suitable fastening means such as adhesive or a mechanical connection.

The end portion 14 includes an annular weight-receiving recess 14*a* defined about axially extending post 14*b* of the end portion coaxial with axis A. The central post 14*b* is connected to and supported by a plurality of radially extending, circumferentially spaced support ribs 14*c* having spaces 14*d* therebetween to permit water, sand and other debris to drain from between the end portion 14 and end E of the tank T. The support ribs 14*c* are connected to outer annular cylindrical shoulder 14*e* of the end portion. The ribs 14*c* include flat, upper reinforcement webs 14*i* formed integral therewith along their lengths. The webs 14*i* expand laterally and are formed integrally with the post 14*b* and shoulder 14*e* at transition locations where the ribs 14*c* encounter the central post 14*b* and the shoulder 14*e*, as shown, for reinforcement purposes. The ribs 14*c* have a "T" shaped transverse cross-section as a result of the webs 14*i* formed integral therewith. The end portion 14 preferably is molded to include the features described above.

The annular recess 14*a* is adapted to receive an annular, disc-shaped weight 18 which is releasably retained in the recess about the post 14*b* by weight retention means 20 in one embodiment comprising an elongated metal or plastic releasable retention pin 22 and cable or connector 24 having a release handle or loop 26. The recess 14*a* is formed between the peripheral, generally cylindrical shoulder 14*e* of the end portion 14 and the central post 14*b*, both molded or otherwise formed on the end portion.

Figure 3:
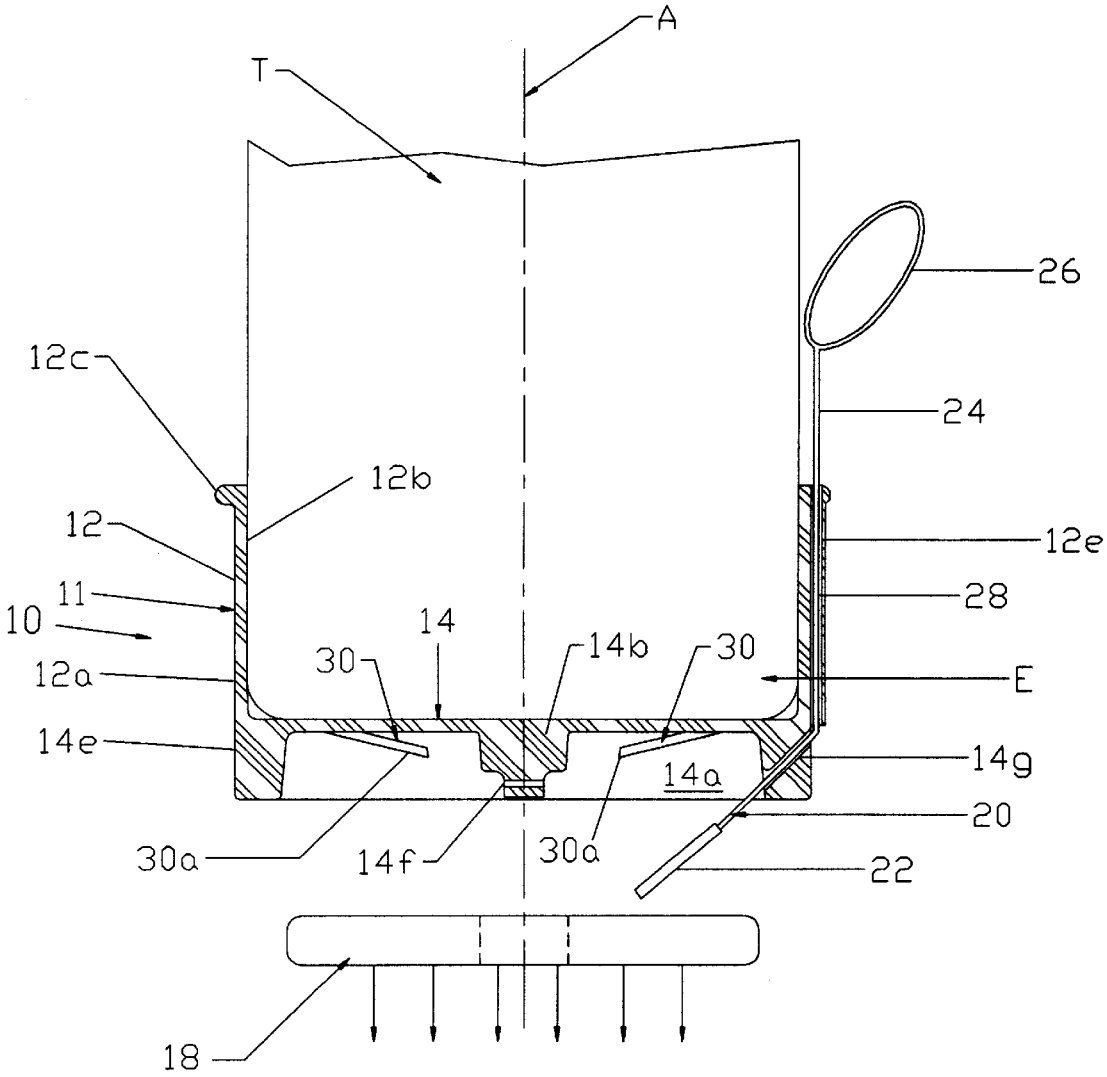
FIG. 3 is a partial elevational view of the end of the scuba tank secured in the ballast boot shown pursuant to an embodiment of the invention and shown in section similar to FIG. 2 with the ballast weight jettisoned from the ballast boot.
Figure 4A:
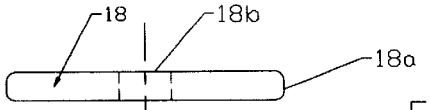
FIG. 4A is a side elevation of the ballast weight of FIG. 4.
Figure 4:
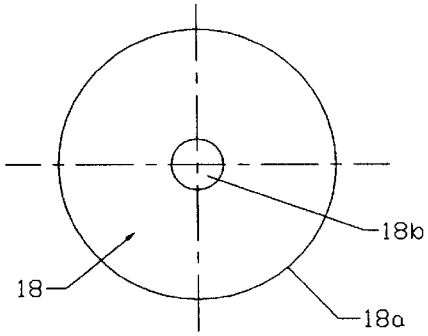
FIG. 4 is an end elevation of the ballast weight.

The annular, disc-shaped weight 18 is shown in FIGS. 4 and 4A and can comprise a lead, steel, cast iron or other suitable weight having an outer circumferential surface 18*a* with outer diameter to fit with clearance (e.g 0.078 to 0.125 inch clearance) in recess 14*a* and and central cylindrical opening 18*b* with inner diameter to fit with clearance (e.g 0.030 to 0.060 inch clearance) about post 14*b*. The recess 14*a* can have an inner wall that tapers outwardly as shown in FIG. 3 to help in release of the weight 18 from the recess 14*a*. The post 14*b* can have an outer wall that tapers inwardly as shown in FIG. 3 to this same end.

In the practice of the invention, multiple ballast weights 18 can be stacked atop one another in recess 14*a* and retained therein by the retention pin 22. For example, FIG. 5B schematically illustrates multiple weights 18 being jettisoned by a diver from the end wall 14 of the ballast boot 10.

Figure 5A:
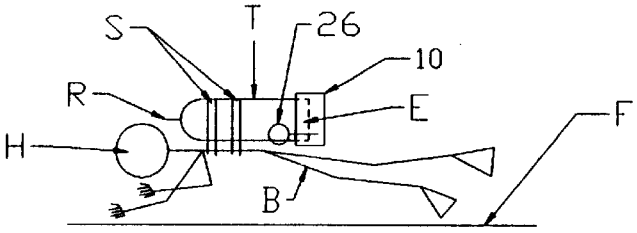
Figure 5B:
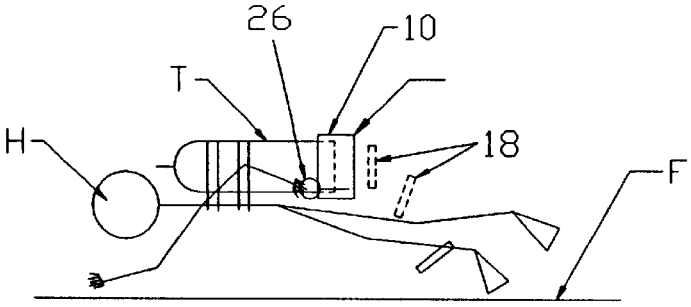
FIG. 5B is a schematic drawing illustrating the scuba diver's body following a period of underwater swimming with ballast weight(s) being jettisoned in preparation for an ascent to the water surface.

For purposes of illustration only, a typical single weight 18 useful in practicing the invention can weigh 5 pounds to offset increasing buoyancy of a conventional (e.g. 80 cubic feet of air capacity) scuba tank T due to usage of air during a dive and to maintain the tank in a generally horizontal attitude, FIG. 5A. Multiple weights, if used, each can weigh appropriate amounts to aggregate that poundage, although the invention is not limited to any particular poundage for weight(s) 18.

Figure 2:
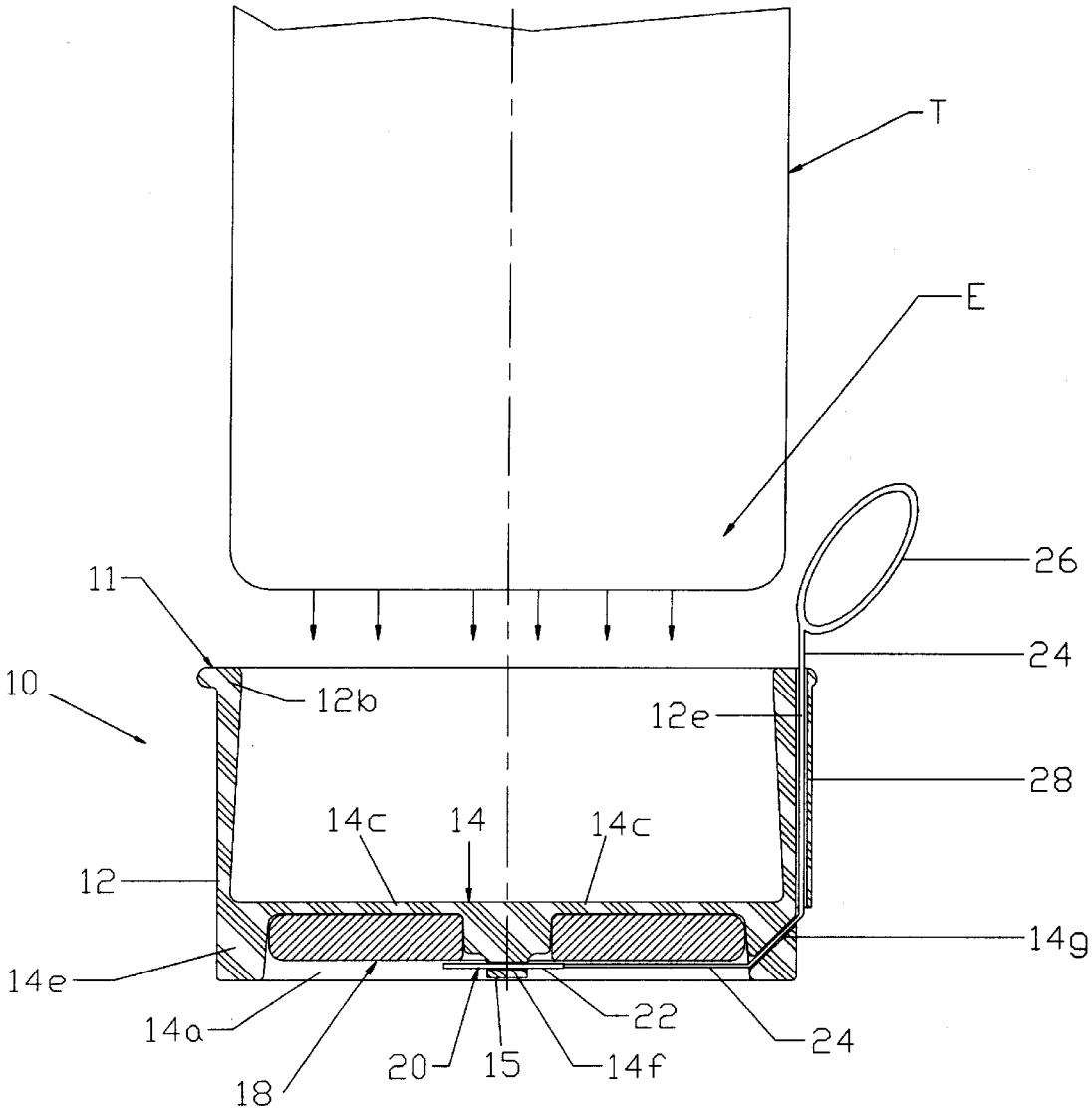
FIG. 2 is a partial elevational view of the end of the scuba tank remote from the diver's head being positioned in a ballast boot pursuant to an embodiment of the invention and shown in section taken along lines 2—2 of FIG. 2A.
Figure 2A:
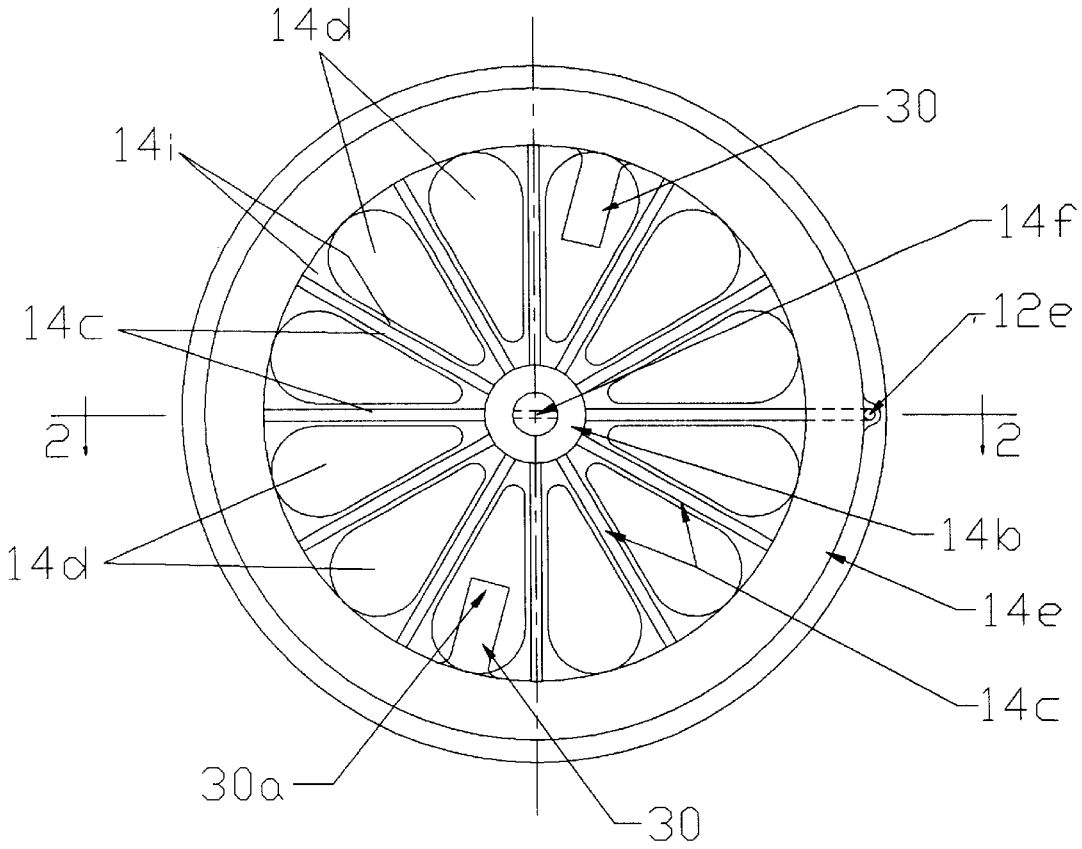
FIG. 2A is an end elevation of the ballast boot sans ballast weight and weight retention means showing details of the end portion.
Figure 3A:
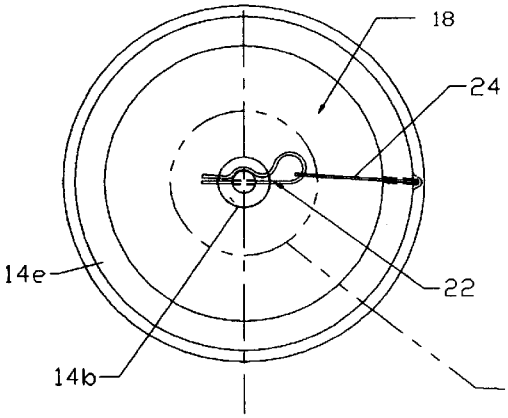
FIG. 3A is an end elevation of the ballast boot with the ballast weight retained on the end portion by a hitch pin.
Figure 3B:
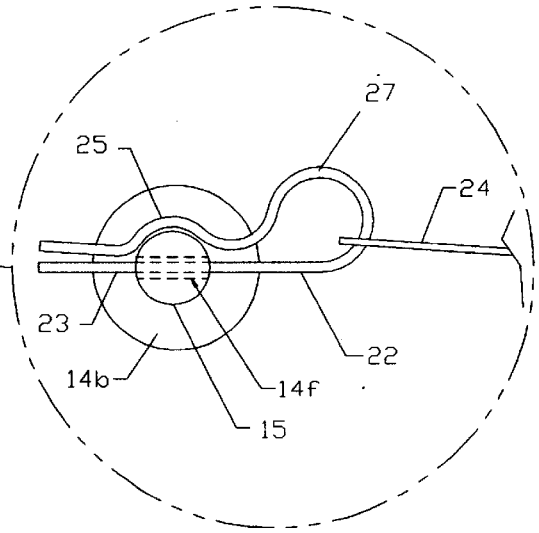
FIG. 3B is an enlarged view of the hitch pin.

The retention pin 22 in the locking position is shown in FIG. 2 extending through a diametral passage 14*f* through a smaller diameter cylindrical end region 15 of the post 14*b*. The retention pin 22 includes opposite ends that protrude beyond the post 14*b* and that underlie the weight 18 proximate the post 14*b* to thereby hold the weight 18 in the recess 14*a*. An alternate retention pin 22 is shown FIG. 3A, 3B as a hitch pin that includes an elongated linear portion 23 extending through passage 14*f* and an arcuate portion 25 extending around the post 14*b* in a manner to underlie the weight 18 proximate the post 14*b* to hold the weight 18 in the recess 14*a*. The hitch pin is connected by a loop 27 to the release connector 24 so that the linear portion can be pulled from the post passage 14*f* to release the ballast weight 18.

In lieu of a retention pin 22, the invention can be practiced using other retention means for retaining the ballast weight 18 in recess 14*a*, including, but not limited to, a C-shaped retention clip (not shown) received in a circumferential groove (not shown) disposed on the out wall of the post 14*b* so that the clip underlies the weight 18 to retain it in the recess 14*a*.

The retention pin 22 is connected to the elongated release cable or connector 24 by being formed integrally therewith or connected thereto by suitable fastening means, such as a loop, welding, thread connection, other fastening means. For example, the cable or connector 24 can comprise a length of stainless steel wire (e.g. 0.031 to 0.062 inch diameter) having the retention pin 22 (e.g. 0.062 to 0.078 inch diameter stainless steel pin) joined at one end by staking/crimping and the release handle or loop 26 formed integrally at the other end.

The intermediate length 28 of the cable or connector 24 is slidably received in an axially extending guide passage 12*e* of the wall of the tubular sleeve portion 12 and an oblique guide passage 14*g* of the end portion 14 with the retention pin 22 received in the passage 14*f* of the post 14*b* with its ends protruding beyond the post 14*b* to retain the weight 18 in the recess 14*a*. The release handle or loop 26 is positioned at a diver-accessible position on the ballast boot 11 so as to be readily actuated by the diver to release the retention pin 22 and thereby release the weight 18 for jettisoning from the ballast boot; e.g. as shown in FIG. 3. In particular, the release handle or loop 26 is positioned on the ballast boot 11 forward of the tubular portion 12 toward the diver in a manner that the diver can easily reach back with his or her hand and pull the release handle or loop 26; e.g. see FIG. 5B, to release the retention pin 22 from the post passage 14*f* and release the weight 18.

To assist in ejection or jettisoning of the ballast weight 18 when the release handle 26 is pulled by the diver, the end portion 14 can include optional release springs 30 that engage the weight 18 when it is retained in the recess 14 so that the springs 30 are compressed. The springs 30 can be formed as integrally molded plastic springs as part of the end portion 14, or as separate springs each having one end received in a molded pocket of the end wall. The springs 30 each have a free end 30*a* that engages the weight 18 when it is retained in the recess 14 so that the springs 30 are compressed. The compressed springs 30 exert a spring bias on the weight 18 in a direction to eject the weight from the recess 14*a* when the retention pin 22 is released. The springs can comprise elongated stainless steel to this end. Although two diametrally opposed springs 30 are illustrated, the invention is not so limited and can be practiced with a different number and/or different type of spring that assists in ejecting of the weight 18 from the recess 14*a*.

As illustrated in FIG. 5A, the buoyancy compensator 10 overcomes the aforementioned problem of increasing tank buoyancy in a manner that permits the tank and diver to maintain a near optimum horizontal attitude following a period of underwater swimming. The ballast weight(s) 18 is/are located on the buoyancy compensator 10 near the end E of the tank T at a location of maximum moment relative to the tank so as to optimize the effect of the ballast weight and require less ballast to maintain tank attitude. As shown in FIG. 5B, the diver can actuate the release handle 26 to readily jettison or eject the ballast weight(s) 18 in an emergency situation when the diver needs to surface rapidly.

Although certain embodiments of the invention have been shown and described in detail above, it should be understood that variations and modifications may be made thereto without departing from the spirit and scope of the invention as set forth in the appended claims.

We claim:

1. A tank buoyancy compensator for an underwater breathing tank, comprising a ballast boot having an axially elongated tubular portion for frictionally receiving an end of the tank remote from a diver's head to secure said compensator on said end of said tank and an end portion, said end portion including a releasable weight retention pin that underlies a ballast weight disposed on said end portion for releasably retaining said ballast weight on said end portion, and a cable on said boot connected to said retention pin and extending axially alone said tubular portion so as to be operable by the diver's pulling said cable along said tubular portion for releasing said weight retention pin to release said weight from said boot.

2. The compensator of claim 1 wherein the end portion of said boot includes an annular recess defined about an axially extending post of said end portion and wherein said weight comprises an annular weight disposed in said recess about said post, said retention pin being disposed on said post under said ballast weight to retain said ballast weight in said recess.

3. The compensator of claim 2 wherein said post is supported by a plurality of radially extending support ribs spaced apart to provide openings for water and debris to drain from between the end of said tank and said end portion.

4. The compensator of claim 2 wherein said post extends coaxial with a longitudinal axis of said tubular portion.

5. The compensator of claim 2 wherein the retention pin is connected to said cable with said retention pin and said cable extending under said ballast weight.

6. The compensator of claim 5 wherein said retention pin includes an end received in a passage in said post, said end being pulled from said passage in said post when the diver pulls said release cable.

7. The compensator of claim 6 wherein said post includes a lateral passage for receiving said end of said retention pin.

8. The compensator of claim 1 wherein spring means is disposed on said end portion in a manner to assist in jettisoning said weight.

9. The compensator of claim 8 wherein said spring means comprises a plurality of springs each having a free end for engaging and biasing said weight in a direction to jettison it.

10. A tank buoyancy compensator for an underwater breathing tank, comprising a ballast boot having an axially elongated tubular sleeve portion for frictionally receiving an end of the tank remote from a diver's head to secure said compensator on said end of said tank and an end portion at least partially closing off said sleeve portion, said end portion including an annular weight-receiving recess defined about a projecting post of said end portion, an annular weight disposed in said recess about said post, a releasable retention pin disposed on said post underlying said weight to retain said weight in said recess, and a diver actuated cable attached to said retention pin and extending axially along said tubular portion so as to be actuated by the diver's pulling said cable along said tubular portion to release said retention pin in a manner to release said weight from said end portion.

11. The compensator of claim 10 wherein said post includes a passage for receiving an end of said retention pin and from which said end of said retention pin is removed to release said weight.

12. The compensator of claim 11 wherein said post is supported by a plurality of radially extending support ribs spaced apart to provide openings for water and debris to drain from between the end of said tank and said end portion.

13. The compensator of claim 11 wherein said passage is a diametral passage in said post.

14. The compensator of claim 10 wherein spring means is disposed on said end portion in a manner to assist in jettisoning said weight.

15. The compensator of claim 14 wherein said spring means comprises a plurality of spring members each having a free end for engaging said weight.

16. A method of ballasting an underwater breathing tank, comprising positioning an annular ballast weight in a recess formed about a post extending from an end portion of a ballast boot, positioning a releasable retention pin on said post to retain said ballast weight in said recess between said end portion and said retention pin, connecting said retention pin to a release cable extending axially along an elongated tubular portion of said ballast boot so as to be operable by the diver's pulling said cable along said tubular portion to release said retention pin, and positioning said elongated tubular portion of said ballast boot frictionally on an end of the tank remote from a diver's head to secure said ballast boot on said end of said tank.

17. The method of claim 16 wherein an end of said retention pin is inserted in a passage of said post to retain said weight on said end portion.

18. The method of claim 16 further including releasing said weight from said end portion.

19. The method of claim 18 wherein said weight is released by said diver pulling a cable connected to said retention pin on said boot.

* * * * *

UNITED STATES PATENT AND TRADEMARK OFFICE
CERTIFICATE OF CORRECTION

PATENT NO : 6,030,146

DATED : February 29, 2000

INVENTOR(S) : Wayne L. Nicolen et al.

It is certified that error appears in the above-identified patent and that said Letters Patent is hereby corrected as shown below:

Column 6, line 14: Replace "alone" with ---along---.

Signed and Sealed this

Thirteenth Day of February, 2001

*Attest:*

Nicholas P. Godici

NICHOLAS P. GODICI

*Attesting Officer*

*Acting Director of the United States Patent and Trademark Office*